US010570544B2

(12) United States Patent
Pollett

(10) Patent No.: US 10,570,544 B2
(45) Date of Patent: Feb. 25, 2020

(54) TIMED WASH CYCLE FOR A WASHING MACHINE APPLIANCE

(71) Applicant: Haier US Appliance Solutions, Inc., Wilmington, DE (US)

(72) Inventor: James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 213 days.

(21) Appl. No.: 15/472,332

(22) Filed: Mar. 29, 2017

(65) Prior Publication Data

US 2018/0282929 A1 Oct. 4, 2018

(51) Int. Cl.

| | |
|---|---|
| ***D06F 33/02*** | (2006.01) |
| ***D06F 37/30*** | (2020.01) |
| ***D06F 37/36*** | (2006.01) |
| ***D06F 39/00*** | (2020.01) |
| ***D06F 39/04*** | (2006.01) |
| ***D06F 23/04*** | (2006.01) |
| ***D06F 39/14*** | (2006.01) |
| *D06F 35/00* | (2006.01) |

(52) U.S. Cl.

CPC ..... *D06F 33/02* (2013.01); *D06F 23/04* (2013.01); *D06F 37/304* (2013.01); *D06F 37/36* (2013.01); *D06F 39/003* (2013.01); *D06F 39/005* (2013.01); *D06F 39/045* (2013.01); *D06F 39/14* (2013.01); *D06F 35/005* (2013.01); *D06F 2204/06* (2013.01); *D06F 2204/086* (2013.01); *D06F 2212/02* (2013.01)

(58) Field of Classification Search

None

See application file for complete search history.

(56) References Cited

U.S. PATENT DOCUMENTS

| | | | | |
|---|---|---|---|---|
| 2,986,915 | A * | 6/1961 | Nau | D06F 33/02 68/12.21 |
| 5,634,227 | A * | 6/1997 | Lim | D06F 33/02 8/158 |
| 2005/0144737 | A1* | 7/2005 | Roepke | D06F 39/022 8/158 |
| 2007/0113595 | A1* | 5/2007 | Harwood | D06F 33/02 68/12.01 |
| 2008/0155760 | A1* | 7/2008 | Hoppe | D06F 39/02 8/159 |
| 2012/0006069 | A1* | 1/2012 | Kim | D06F 37/04 68/140 |

(Continued)

FOREIGN PATENT DOCUMENTS

| | | |
|---|---|---|
| EP | 2122037 A1 | 11/2009 |
| EP | 2876194 A1 | 11/2013 |

(Continued)

*Primary Examiner* — Cristi J Tate-Sims

(74) *Attorney, Agent, or Firm* — Dority & Manning, P.A.

(57) ABSTRACT

A washing machine appliance for performing timed wash cycles is provided. The washing machine appliance receives a total cycle time for a timed wash cycle. A fill time of a fill cycle portion of the timed wash cycle is determined. Then, one or more cycle times of the remaining one or more cycle portions of the timed wash cycle are adjusted based at least in part on the total cycle time and the fill time such that the timed wash cycle is completed by the total cycle time.

20 Claims, 7 Drawing Sheets

(56) References Cited

U.S. PATENT DOCUMENTS

| | | | | |
|---|---|---|---|---|
| 2012/0012135 | A1* | 1/2012 | Hong | D06F 33/02 134/18 |
| 2013/0312202 | A1* | 11/2013 | Balinski | D06F 33/02 8/137 |
| 2016/0222574 | A1* | 8/2016 | Bae | D06F 33/02 |

FOREIGN PATENT DOCUMENTS

| | | | | |
|---|---|---|---|---|
| EP | 2876194 | A1 * | 5/2015 | D06F 58/28 |
| KR | 20100052207 | A | 5/2010 | |

* cited by examiner

TIMED WASH CYCLE FOR A WASHING MACHINE APPLIANCE

FIELD OF THE INVENTION

The present subject matter relates generally to washing machine appliances and more particularly to washing machine appliances capable of performing timed wash cycles.

BACKGROUND OF THE INVENTION

One issue with conventional washing machine appliances is that their total cycle times are unpredictable. Meaning, from load to load, users are left to guess or estimate when their washed laundry articles are to be completed. Total cycle times may vary from load to load due to varying sense/fill and drain cycle times. The sense/fill and drain times may vary because of certain factors, such as e.g., the size of the load placed within the wash chamber and the selected temperature of the wash liquid. For instance, generally, a greater quantity of wash liquid is filled into the tub for larger loads than for smaller loads. As it takes more time to fill the tub with a greater quantity of wash liquid than it does a smaller quantity, the sense/fill and drain times for larger loads generally take longer than the fill and drain times for smaller loads. These various factors create unpredictability in total cycle times, and thus, users may be inconvenienced.

Other issues with conventional washing machine appliances is that they generally do not provide users with the ability to control the time of a wash cycle or the ability to shorten the total cycle time whilst still performing the full wash cycle (i.e., still performing the sense/fill, wash, drain, rinse, and spin cycle portions). In some cases, users have a limited amount of time to wash laundry items. Without the ability to control the cycle time of the wash cycle, users are unable to select a cycle time that fits their schedule. This lack of functionality can be frustrating and inconvenient to users. Moreover, to wash laundry items within a shorten period of time, in some cases, users operate a washing machine appliance to perform a wash cycle and simply remove the laundry articles midway through the wash cycle. In this way, some of the cycle portions may not have been performed. For example, the articles may not have undergone a spin cycle portion and consequently the articles may be wet when removed from the wash chamber. This lack of functionality can likewise be frustrating and inconvenient to users.

Accordingly, improved washing machine appliances capable of performing timed washed cycles are desired.

BRIEF DESCRIPTION OF THE INVENTION

The present disclosure provides a washing machine appliance capable of performing timed wash cycles. The washing machine appliance receives a total cycle time for a timed wash cycle from e.g., a user of the appliance. A fill time of a fill cycle portion of the timed wash cycle is determined. Then, one or more cycle times of the remaining one or more cycle portions of the timed wash cycle are adjusted based at least in part on the total cycle time and the fill time such that the timed wash cycle is completed by the total cycle time. Additional aspects and advantages of the invention will be set forth in part in the following description, or may be apparent from the description, or may be learned through practice of the invention.

In accordance with one embodiment, a method for operating a washing machine appliance in a timed wash cycle is provided. The timed wash cycle includes one or more cycle portions each having a corresponding cycle time. The method includes receiving a total cycle time $t_{TOTAL}$ for the timed wash cycle; determining a fill time $t_{FILL}$ of a fill cycle portion of the timed wash cycle in which the washing machine appliance is filled to a predetermined fill level with a wash liquid; and adjusting one or more of the cycle times of the remaining cycle portions of the timed wash cycle based at least in part on the total cycle time $t_{TOTAL}$ and the fill time $t_{FILL}$ such that the timed wash cycle is completed by the total cycle time $t_{TOTAL}$.

In some various embodiments, the washing machine appliance includes an agitation element and the timed wash cycle includes a wash cycle portion, and during the wash cycle portion, the method further includes: adjusting an agitation level of the agitation element based at least in part on the total cycle time $t_{TOTAL}$ such that the articles within the washing machine appliance are agitated more aggressively.

In some various embodiments, the method further includes adjusting a wash liquid temperature of a wash liquid filling into the washing machine appliance during one or more of the cycle portions of the timed wash cycle based at least in part on the total cycle time $t_{TOTAL}$ such that the articles within the washing machine appliance are subjected to more aggressive thermal action.

In some various embodiments, the washing machine appliance includes a cabinet defining an opening and a wash tub positioned within the cabinet. A wash basket is rotatably mounted within the tub and defines a wash chamber for receiving articles for washing. During one or more of the cycle portions of the timed wash cycle, the method further includes: adjusting a spin speed of the wash basket based at least in part on the total cycle time $t_{TOTAL}$ such that the articles within the washing machine appliance are spun more aggressively.

In some embodiments, the method further includes: receiving one or more cycle parameters, wherein the one or more cycle parameters include at least one of: a wash liquid temperature, a soil level, and a spin speed; and adjusting one or more of the cycle parameters such that the one or more articles received within the washing machine appliance are subjected to increased mechanical action or increased thermal action during one or more cycle portions of the timed wash cycle.

In accordance with another embodiment, a washing machine appliance for performing a timed wash cycle that includes one or more cycle portions each having a corresponding cycle time is provided. The washing machine appliance includes a cabinet defining an opening. The washing machine appliance includes a wash tub positioned within the cabinet and a wash basket rotatably mounted within the tub. The wash basket defines a wash chamber for receiving articles for washing. The washing machine appliance further includes a control panel attached to or integral with the cabinet and comprising one or more input selectors for selecting a total cycle time $t_{TOTAL}$ for the timed wash cycle. The washing machine appliance also includes a controller operatively coupled with the control panel, the controller configured to: receive the total cycle time $t_{TOTAL}$ for the timed wash cycle; determine an initial fill time $t_{FILL}$ of an initial fill cycle portion for a wash liquid to fill into the wash tub to a predetermined fill level; and adjust one or more of the cycle times of the remaining cycle portions of the timed wash cycle based at least in part on the total cycle time $t_{TOTAL}$ and the initial fill time $t_{FILL}$ such that the timed wash cycle is completed by the total cycle time $t_{TOTAL}$.

In some various embodiments, the timed wash cycle includes a wash cycle portion. The washing machine appliance further includes an agitation element configured to agitate articles received within the wash chamber, and wherein the agitation element is operatively coupled with the controller; and wherein the controller is further configured to: adjust an agitation level of the agitation element during the wash cycle portion based at least in part on the total cycle time $t_{TOTAL}$ such that articles received within the wash chamber are agitated more aggressively.

In some various embodiments, the initial fill time $t_{FILL}$ is based at least in part on a load size of articles received within the wash chamber.

In some various embodiments, the initial fill time $t_{FILL}$ is based at least in part on the type of articles received within the wash chamber.

In some various embodiments, the timed wash cycle includes a fill cycle portion and wherein the controller is further configured to: adjust a wash liquid temperature of a wash liquid filling into the wash chamber during the fill cycle portion based at least in part on the total cycle time $t_{TOTAL}$ such that the articles within the wash chamber are subjected to more aggressive thermal action.

In some various embodiments, the wash basket is operatively coupled with the controller, and wherein the controller is further configured to: adjust a spin speed of the wash basket based at least in part on the total cycle time $t_{TOTAL}$ such that the articles within the wash chamber are spun more aggressively.

In accordance with yet another embodiment, a method for operating a washing machine appliance in a timed wash cycle is provided. The timed wash cycle includes one or more cycle portions each having a corresponding cycle time. The method includes receiving a total cycle time $t_{TOTAL}$ for the timed wash cycle; determining the cycle time for each cycle portion of the timed wash cycle based at least in part on the total cycle time $t_{TOTAL}$; and operating the washing machine appliance in the timed wash cycle such that the timed wash cycle is completed by the total cycle time $t_{TOTAL}$.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
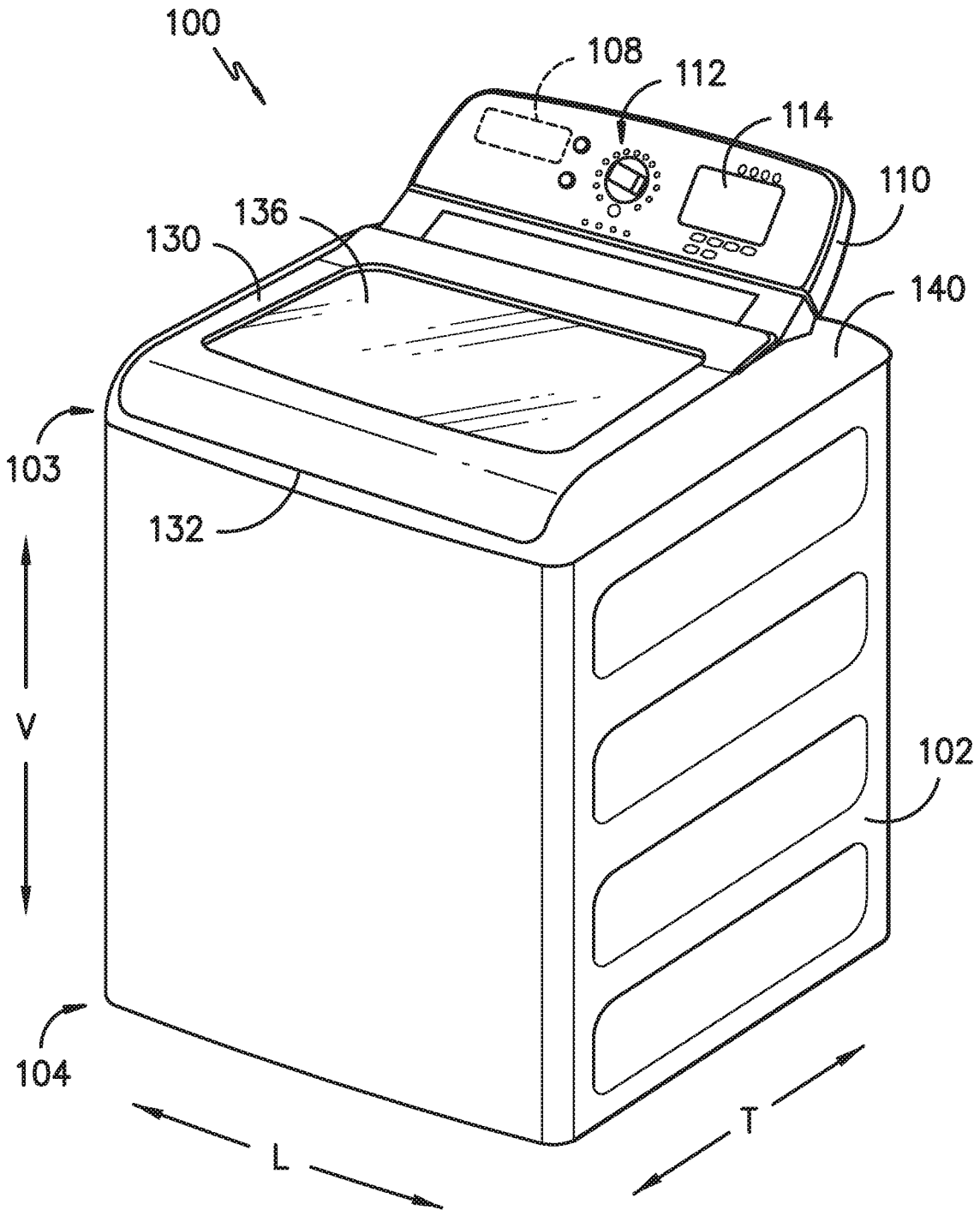
FIG. 1 provides a perspective view of a washing machine appliance in accordance with exemplary embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
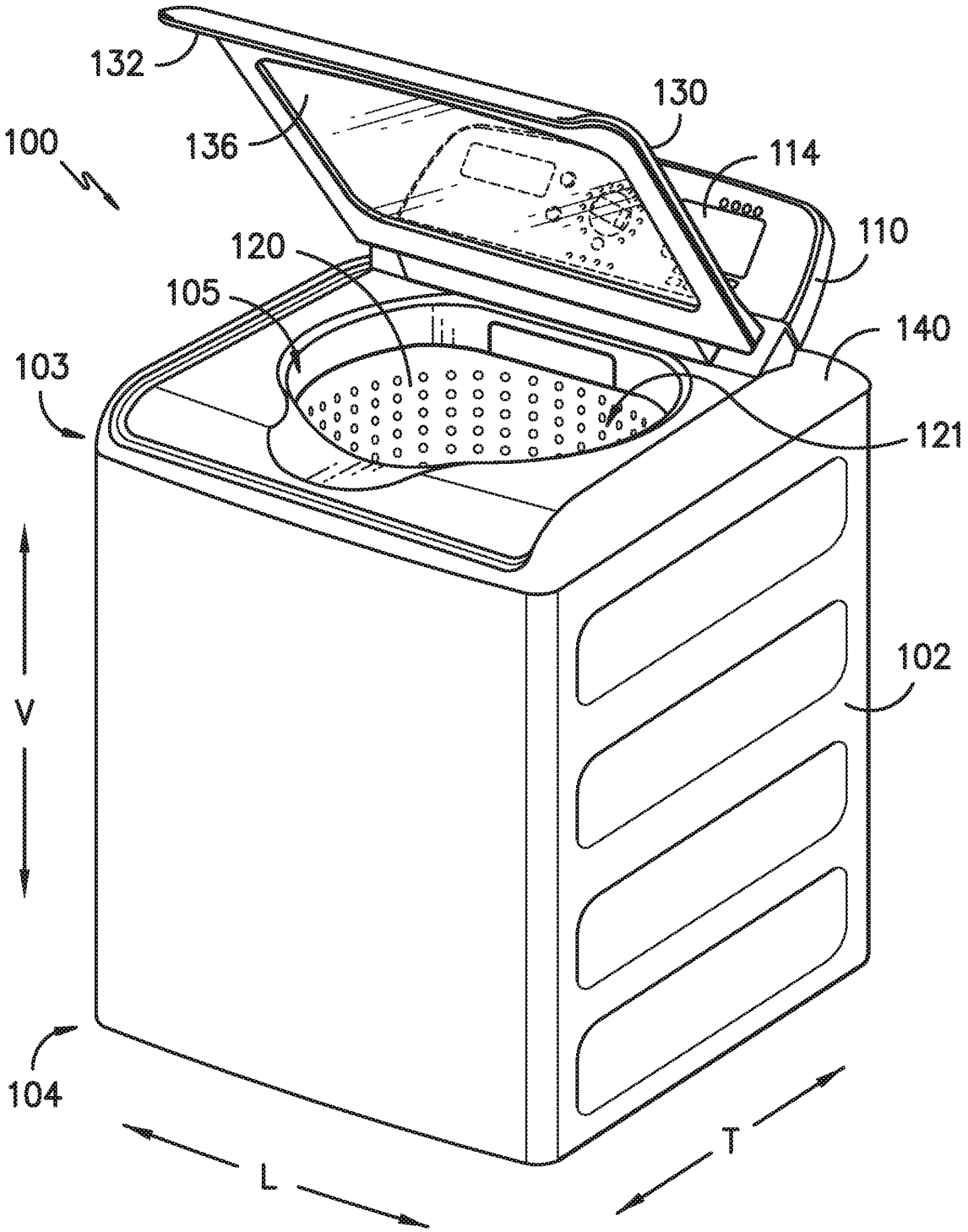
FIG. 2 provides a perspective view of the washing machine appliance of FIG. 1 with the door shown in an open position.
Figure 3:
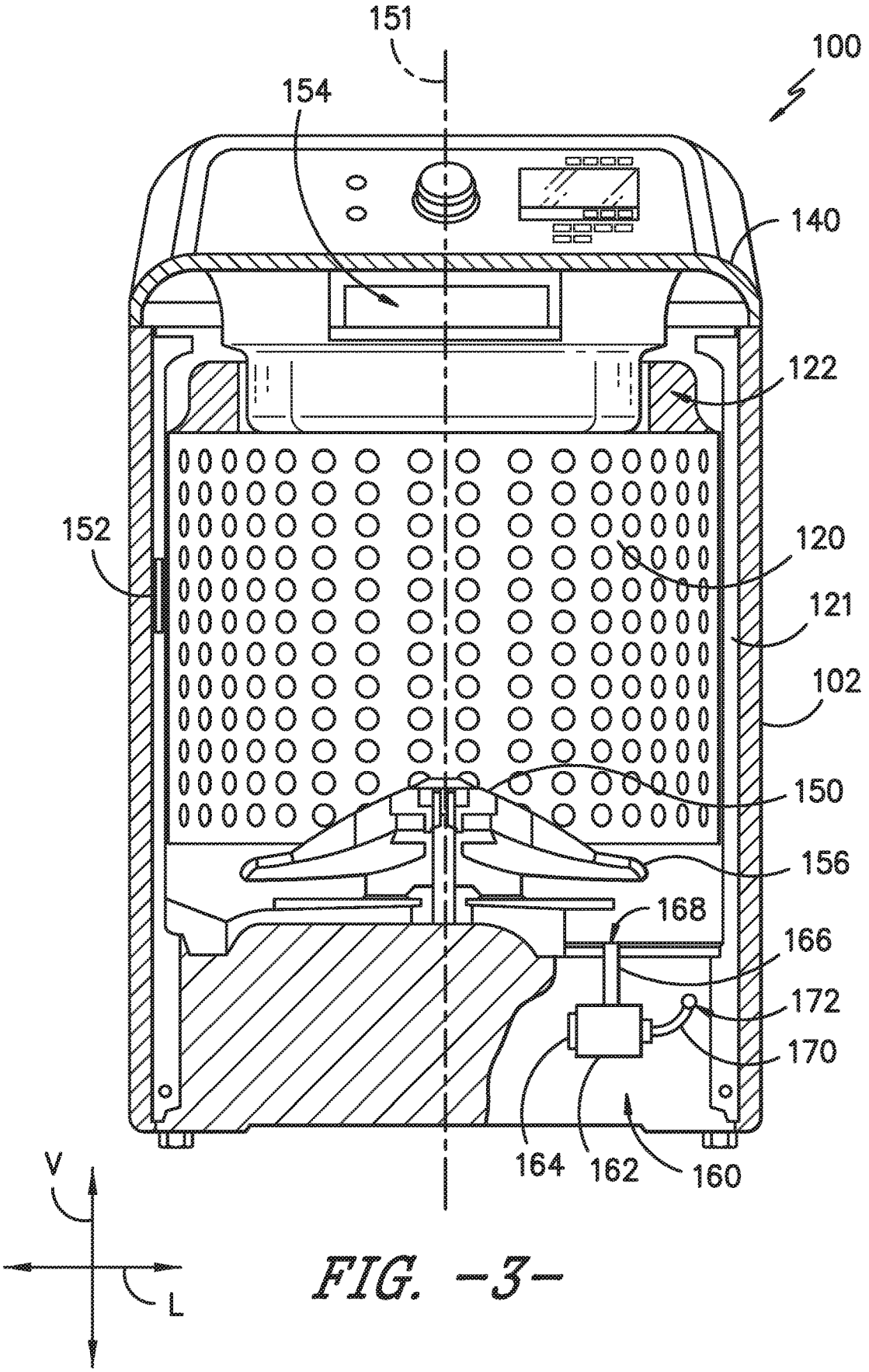
FIG. 3 is a front cross-sectional view of the washing machine appliance of FIG. 1.

FIGS. 1 through 3 illustrate an exemplary embodiment of a vertical axis washing machine appliance 100. In FIG. 1, a lid or door 130 is shown in a closed position. In FIG. 2, door 130 is shown in an open position. In FIG. 3, a front cross-sectional view of washing machine appliance 100 is provided. Washing machine appliance 100 generally defines a vertical direction V, a lateral direction L, and a transverse direction T, each of which is mutually perpendicular such that an orthogonal coordinate system is generally defined.

While described in the context of a specific embodiment of vertical axis washing machine appliance 100, using the teachings disclosed herein it will be understood that vertical axis washing machine appliance 100 is provided by way of example only. Other suitable washing machine appliances having different configurations, different appearances, and/or different features may also be utilized with the present subject matter as well, such as e.g., horizontal axis washing machines.

Washing machine appliance 100 has a cabinet 102 that extends between a top portion 103 and a bottom portion 104 along the vertical direction V. A perforated wash basket 120 (FIG. 2) is rotatably mounted within cabinet 102. A motor (not shown) is in mechanical communication with wash basket 120 to selectively spin or rotate wash basket 120 (e.g., during a wash, rinse, or spin cycle portion of a wash cycle). Wash basket 120 is received within a wash tub 121 (FIGS. 2 and 3) for receipt of articles for washing. Wash tub 121 holds wash and rinse fluids for agitation and washing of articles received within wash basket 120. The perforations of wash basket 120 provide fluid communication between wash basket 120 and wash tub 121.

An agitation element 150 (FIG. 3) extends from the bottom wall of wash tub 121 into wash basket 120 along the vertical direction V. Agitation element 150 is also in mechanical communication with the motor (not shown) such that agitation element 150 can be driven or rotated about a vertical axis 151 for agitation of the laundry articles. Specifically, agitation element 150 includes one or more blades or vanes 156 extending outwardly from vertical axis 151 along the lateral and transverse directions L, T for agitating the laundry articles and moving the wash liquid about (only lateral vanes are shown in FIG. 3). Although agitation element 150 is shown as an impeller in FIG. 3, agitation element 150 can be any suitable type of agitation device capable of agitating the articles received within wash basket 120, such as e.g., a vane agitator, impeller, auger, or some combination thereof.

Washing machine appliance 100 also includes a pressure sensor 152 (FIG. 3) configured to detect a plurality of fluid levels in wash tub 121. Pressure sensor 152 may be a multiple stage pressure sensor, for example. Liquid levels (e.g., water or wash liquid levels), and more specifically, changes in liquid levels in wash tub 121 may therefore be sensed, for example, to indicate the quantity of wash liquid within wash tub 121 and to facilitate associated control decisions.

Washing machine appliance 100 further includes a pump assembly 160 (FIG. 3) located beneath wash tub 121 and wash basket 120 for gravity assisted flow when draining wash tub 121 of wash liquid. Pump assembly 160 includes a pump 162 and a pump motor 164. Pump 162 may be a single speed or variable speed pump, for example. A pump inlet hose 166 extends from a drain 168 defined in the bottom wall of wash tub 121 to an inlet of pump 162. A pump outlet hose 170 extends from an outlet of pump 162 to a washing machine appliance outlet 172, which in this embodiment is defined in the rear wall of cabinet 102. In this manner, soiled or dirty wash liquid (i.e., greywater) can be drained from washing machine appliance 100 and routed to a drainage system.

Cabinet 102 of washing machine appliance 100 has a top panel 140. Top panel 140 defines an opening 105 (FIG. 2) that permits user access to wash basket 120 of wash tub 121. Door 130, rotatably mounted to top panel 140, permits selective access to opening 105; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any other suitable support.

A control panel 110 with at least one input selector 112 (FIG. 1) extends from top panel 140. Control panel 110 and input selectors 112 collectively form a user interface for user selection of machine cycle settings, parameters, and features, such as e.g., selecting a timed wash cycle.

Figure 4:
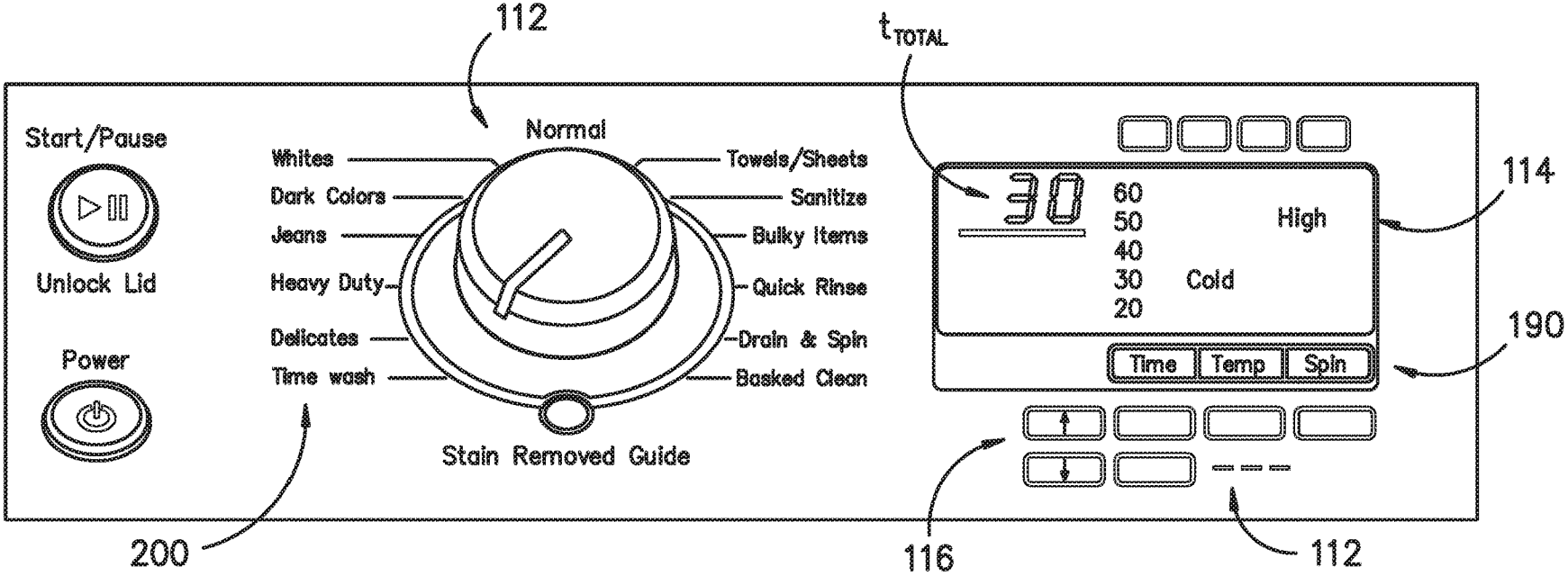
FIG. 4 is a close-up view of a user interface of the washing machine appliance of FIG. 1.

More particularly, FIG. 4 provides a close-up view of a part of control panel 110 of washing machine appliance 100. As shown, control panel 110 includes a rotary dial input selector 112 that can be rotated to the desired wash cycle setting. For this exemplary embodiment, one such cycle setting is a "time wash" or timed wash cycle 200. The timed wash cycle setting allows users to select a total cycle time $t_{TOTAL}$, such as e.g., a twenty (20), thirty (30), forty (40), fifty (50), or sixty (60) minute timed wash cycle. Any suitable total cycle time $t_{TOTAL}$ is contemplated and is not limited to the exemplary total cycle time $t_{TOTAL}$ given above. Timed wash cycles 200 provide users with predictable total cycle times $t_{TOTAL}$ in which their laundry items will be washed. As used herein, "total cycle time" means the entire time interval from the moment a user selects the start button or otherwise initiates a wash cycle until washing machine appliance 100 stops further operations. As such, a "wash cycle" can include various cycle portions or sub cycles, such as e.g., load sensing, filling to an appropriate wash liquid level, agitating the articles submerged within the wash liquid (e.g., water and detergent), draining the wash liquid, spinning the articles, filling to an appropriate rinse liquid level, agitating the articles in or with the rinse liquid, and spinning to remove the rinse liquid. Alternatively, wash cycle could repeat or omit one or more of the noted cycle portions. Other examples of wash cycles will be apparent to one of ordinary skill in the art using the teachings disclosed herein.

Upon selecting the timed wash cycle 200 with rotary dial input selector 112, a user can then use other input selectors 112, such as a touch screen or input buttons, to select the desired total cycle time $t_{TOTAL}$. As shown in FIG. 4, a display 114 of control panel 110 can provide users with a visual interface to select the desired total cycle time $t_{TOTAL}$. In this example, a user has selected thirty (30) minutes as the desired total cycle time $t_{TOTAL}$. A user may select the desired total cycle time $t_{TOTAL}$ by using input selectors 112 with up and down arrow buttons, denoted by 116. In addition, one or more cycle parameters 190 can be selected, such as e.g., temperature of the wash liquid temperature (i.e., hot, warm, cold, etc.), a soil level, a spin speed, etc. One or more input selectors 112 can be used to select such cycle parameters 190. For example, a user could select the desired wash liquid temperature for the wash cycle by selecting the "Temp" input selector 112 to scroll through the temperature options until the desired temperature is selected, which in FIG. 4 is a "Cold" temperature option. Display 114 can be used to indicate such selected features, operation mode, a countdown timer, and/or other items of interest to appliance users regarding operation.

Operation of washing machine appliance 100 is controlled by a processing device or controller 108 (FIG. 1) that is operatively coupled with control panel 110 for user manipulation to select washing machine cycles, parameters, and features. In response to user manipulation of control panel 110, controller 108 operates the various components of washing machine appliance 100 to execute selected machine cycles and features, including those described herein. In particular, controller 108 can be operatively coupled with: the motor that drives wash basket 120 and agitation element 150, pressure sensor 152, as well as motor 164 that drives pump 162 for draining wash tub 121. Controller 108 may also be operatively coupled with other components of washing machine appliance 100.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

Generally, in an illustrative example of the operation of washing machine appliance 100, laundry articles are loaded into wash basket 120 through opening 105, and a wash cycle is initiated through user manipulation of input selectors 112. Wash basket 120 is filled with water and detergent and/or other fluid additives via an additive dispenser 154, which may occur after the load size in sensed. One or more valves (not shown) can be controlled by washing machine appliance 100 to provide for filling wash tub 121 to the appropriate level based upon the load size of the articles received within wash basket 120. Once wash basket 120 is properly filled with wash liquid, the contents of wash basket 120 are agitated (e.g., with agitation element 150) for washing of laundry items in wash basket 120.

Thereafter, wash tub 121 can be drained of the soiled wash liquid. Laundry articles can then be rinsed by again adding fluid to wash basket 120 depending on the specifics of the wash cycle selected by a user. The agitation element 150 may again provide agitation within wash basket 120. One or more spin cycle portions may also be used after the wash cycle portion, before the rinse cycle portion, and then again after the rinse cycle portion. In particular, a spin cycle portion may be applied after the wash cycle portion and/or after the rinse cycle portion to wring wash fluid from the articles being washed. During a spin cycle portion, wash basket 120 is rotated at relatively high speeds. After articles disposed in wash basket 120 are cleaned and/or washed, the user can remove the articles from wash basket 120, e.g., by reaching into wash basket 120 through opening 105. An exemplary wash cycle of washing machine appliance 100 will now be described in more detail.

Figure 5:
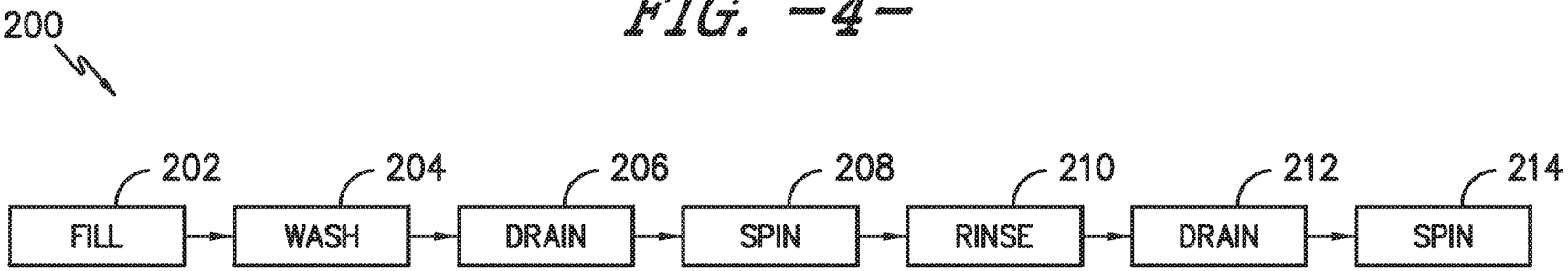
FIG. 5 provides a flow diagram of cycle portions of an exemplary timed wash cycle in accordance with embodiments of the present disclosure.

FIG. 5 provides a flow diagram of various cycle portions of an exemplary timed wash cycle 200 in accordance with embodiments of the present disclosure. Specifically, exemplary timed wash cycle 200 includes a fill cycle portion 202 (or initial fill cycle portion), a wash cycle portion 204, a first drain cycle portion 206, a first spin cycle portion 208, a rinse cycle portion 210, a second drain cycle portion 212, and a second spin cycle portion 214. Each cycle portion has a corresponding or associated cycle time in which the cycle portion is performed by washing machine appliance 100. The summation of the cycle times is equal to the total cycle time $t_{TOTAL}$, as shown by the equation below:

$$\begin{array}{c} \text{Fill Time } t_{FILL} \\ \text{Wash Time } t_{WASH} \\ \text{First Drain Time } t_{FIRST\ DRAIN} \\ \text{First Spin Time } t_{FIRST\ SPIN} \\ \text{Rinse Time } t_{RINSE} \\ \text{Second Drain Time } t_{SECOND\ DRAIN} + \\ \text{Second Spin Time } t_{SECOND\ SPIN} \\ \hline \text{Total Cycle Time } t_{TOTAL} \end{array} \qquad \text{(Equation 1)}$$

Each cycle portion of timed wash cycle 200 will be described in turn. General reference to the components illustrated in FIGS. 1-4 and described in the accompanying text will also be referenced.

While timed wash cycle 200 is described as having specific cycle portions in a particular order, using the teachings disclosed herein it will be understood that exemplary timed wash cycle 200 is provided by way of example only. Other suitable timed wash cycles 200 having different cycle portions, order of cycle portions, and/or differences more generally may also be applicable to the teachings disclosed herein.

During the fill cycle portion 202, in some embodiments, the washing machine appliance 100 uses a precise fill or auto load sensing technique to determine the load size of the articles received within wash basket 120 such that the optimal wash liquid fill level can be determined. Methods for determining the load size are known in the art. By way of example, the wash basket 120 may be spun to a given spin speed and then stopped such that controller 108 or other sensing device can determine the inertial mass of the load, thereby allowing washing machine appliance 100 to determine the load size. Based on the load size, wash tub 121 is filled with wash liquid to the corresponding predetermined fill level. As another example, the absorbency of the fabric can be sensed to determine the load size.

In addition to the load size or weight of the items within wash basket 120, the quantity of wash liquid that fills into wash tub 121 may also depend on the type of fabrics loaded into wash basket 120. Consequently, the fill time may depend at least in part on the type of fabrics loaded into wash basket 120. The fabric types of the laundry items within wash basket 120 may affect the quantity of wash liquid that fills into wash tub 121, because different fabrics absorb different amounts or quantities of wash liquid. For instance, cotton fabrics typically require more wash liquid than synthetic materials (e.g., polyester) for the same load weight due to the difference in the absorption properties between cotton and synthetic materials.

As the quantity of wash liquid that fills into wash tub 121 is dependent on the load size and fabric types, the fill cycle portion 202 is a variable time cycle portion of timed wash cycle 200. Stated alternatively, as the load size varies from load to load, the time associated with the fill cycle portion 202 varies as well. To account for this variability, controller 108 or washing machine 100 more generally may include a timing device to time, calculate, or track the initial fill time $t_{FILL}$, or the amount of time it takes the wash liquid to fill into wash tub 121 to the designated predetermined fill level. More specifically, in some embodiments, the cycle time for the fill cycle portion 202 is a time period extending from when a user selects a "start" input selector to start the wash cycle to when the predetermined fill level is achieved. Pressure sensor 152 can send a signal to controller 108 when the predetermined fill level is reached, for example. The fill time $t_{FILL}$ can include both the time it takes to sense the load within washing machine appliance 100 and the time it takes to fill washing machine appliance 100 with wash liquid. Once the initial fill time $t_{FILL}$ is known, the cycle times of the remaining cycle portions of timed wash cycle 200 can be adjusted such that timed wash cycle 200 is completed by the selected total cycle time $t_{TOTAL}$.

By way of example, if the load sensing and the initial filling of wash tub 121 took six (6) minutes to complete (i.e., a six (6) minute fill time $t_{FILL}$), and a user selected a twenty (20) minute total cycle time $t_{TOTAL}$ for the timed wash cycle 200, controller 108 makes the necessary calculations and adjustments such that the remaining cycle portions of timed wash cycle 200 are completed within the remaining fourteen (14) minutes of the twenty (20) minute timed wash cycle 200. In this way, even with a shorter, more aggressive timed wash cycle 200, such as a twenty (20) minute timed wash cycle 200, the articles undergo a complete wash cycle (i.e., the articles undergo the remaining wash, drain, rinse, and spin cycle portions).

In some exemplary embodiments, once the load size is determined, the initial fill time $t_{FILL}$ can be estimated, and based on the estimated fill time, the cycle times of the remaining cycle portions of wash cycle 200 can be adjusted such that wash cycle 200 is completed by the selected total cycle time $t_{TOTAL}$. In some embodiments, the initial fill time $t_{FILL}$ is predicted based at least in part on one or more past fill times for a particular load size. Stated alternatively, past fill history for a particular load size can be used to predict the fill time for the current load. In other exemplary embodiments, the initial fill time $t_{FILL}$ is predicted based at least in part on one or more past fill times for a particular load size and the type of articles received within wash basket 120. The type of articles received within wash basket 120 can be determined by a user by selecting one or more inputs selectors 112, for example. For instance, a user could select "Heavy Duty" or "Delicates" for the article type and the fill time associated with those particular loads can be stored in the memory of controller 108 to make future predictions as to the fill time for the current load. In yet other exemplary embodiments, the initial fill time $t_{FILL}$ is predicted based at least in part on one or more fill time models. The fill time models can be based upon an average fill time for a particular load for the given washing machine model, for example.

In yet other exemplary embodiments, washing machine appliance 100 may not be configured with load-sensing functionality. In such washing machine appliances, the load size may be determined by other means, such as by user selection of the load size. For example, a user could select the load size as a large, medium, or small load by one or more user input selectors 112. Once the user has selected the load size, the predetermined fill level is determined based upon the selected load size and the wash tub 121 is filled with wash liquid accordingly.

After wash tub 121 is filled with wash liquid to the predetermined fill level, the articles undergo the wash cycle portion 204 of the timed wash cycle 200. During the wash cycle portion 204, agitation element 150 agitates the articles within wash basket 120 to wash the articles. Stains, dirt and debris, and other undesirable elements are separated from the laundry articles through mechanical, chemical, and thermal action or a combination thereof. Specifically, the articles can be washed by mechanical action via agitation element 150. The articles can be agitated by rubbing against agitation element 150, by rubbing against one another, and/or by being moved about the wash liquid. Additionally or alternatively, the articles can be agitated by mechanical action by spinning or rotation of wash basket 120. The articles can be washed by chemical action via one or more detergents, bleach, additives, or a combination thereof. The articles can also be subjected to thermal action by the selected temperature of the wash liquid. Generally, the warmer the temperature of the wash liquid, the greater the thermal action acting on articles. Conversely, the cooler the temperature of the wash liquid, the less thermal action acting on the articles. Other suitable methods for washing the articles within wash basket 120 via mechanical, chemical, and/or thermal action are also contemplated.

The wash time $t_{WASH}$ of the wash cycle portion 204 is adjustable. That is, when a shorter, more aggressive timed wash cycle 200 is selected by a user, the wash cycle portion 204 can be shortened in time to achieve the goal of finishing the timed wash cycle 200 by the selected total cycle time $t_{TOTAL}$. Conversely, if a longer, less aggressive timed wash cycle 200 is selected by a user, the wash cycle portion 204 can be lengthened as necessary.

In particular, for shorter, more aggressive total cycle times $t_{TOTAL}$, various steps can be taken during the wash cycle portion 204 to ensure that the articles are washed thoroughly despite the shorten wash time $t_{WASH}$. For example, the agitation level of agitation element 150 can be adjusted. Specifically, the frequency, rotational speed, or torque of agitation element 150 can be increased such that the articles are agitated more vigorously by agitation element 150 and against one another, thereby increasing the mechanical action on the articles. Additionally or alternatively, wash basket 120 can be rotated with increased spin speed to further agitate the articles with increased mechanical action.

In other embodiments, for shorter, more aggressive total cycle times $t_{TOTAL}$, the wash liquid temperature can be adjusted by increasing the temperature of the water filling into wash tub 121 of washing machine appliance 100. This can be accomplished by known methods, such as by e.g., opening up one or more valves connected to a hot water line, utilizing a heating element to warm the water, etc. In this way, the articles can be subjected to greater thermal action. Conversely, for longer, less aggressive total cycle times $t_{TOTAL}$, the wash liquid temperature can be adjusted by decreasing the temperature of the water filling into wash tub 121 of washing machine appliance 100. In this way, energy can be saved.

In some embodiments, for shorter, more aggressive total cycle times $t_{TOTAL}$, the quantity of detergent and/or other fluid additives filled into wash basket 120 via additive dispenser 154 can be increased. In this way, the chemical action acting on the laundry items can be increased, and as a result, the laundry items may be better washed despite the shorter, more aggressive total cycle time $t_{TOTAL}$. For instance, some washing machine appliances have additive dispensers with bulk dispense capability (i.e. they store multiple loads of detergent in a tank and can deliver one or more doses per cycle portion or wash cycle more generally). Controller 108 can be configured to control the quantity of additives added to wash basket 120 via additive dispenser 154 based at least in part on the selected total cycle time $t_{TOTAL}$.

After the wash cycle portion 204, the wash liquid is drained from wash tub 121 through drain 168 during the first drain cycle portion 206. In this way, the dirt, contaminants, and other debris separated from the articles during the wash cycle portion 204 can exit wash tub 121. Where pump 162 is a single speed pump, the cycle time of the first drain cycle portion 206 is largely fixed, and thus the first drain time $t_{FIRST\ DRAIN}$ is largely dependent on the quantity of liquid initially filled into wash tub 121 during the fill cycle portion 202. Where the drain rate of washing machine appliance 100 is known, controller 108 can calculate the first drain time $t_{FIRST\ DRAIN}$ and can adjust the cycle times of the other cycle portions of wash cycle 200 accordingly.

In some embodiments, the cycle time for the first drain cycle portion 206 may be variable, particularly where pump 162 is a variable speed pump. For shorter, more aggressive total cycle times $t_{TOTAL}$, pump 162 can be configured to pump the wash liquid from wash tub 121 at a faster rate such that the cycle time for the first drain cycle portion 206 is shortened. For longer, less aggressive total cycle times $t_{TOTAL}$ pump 162 can be configured to pump the wash liquid from wash tub 121 at a slower rate such that energy can be conserved, among other benefits.

After the first drain cycle portion 206 of wash cycle 200, the articles within washing machine appliance 100 undergo the first spin cycle portion 208. During the first spin cycle portion 208, wash basket 120 is spun or rotated about such that wash liquid is wrung from the articles within wash chamber 121. In some embodiments, for shorter, more aggressive total cycle times $t_{TOTAL}$, the first spin time $t_{FIRST\ SPIN}$ of the first spin cycle portion 208 can be shortened in time to accommodate the shorter total cycle time $t_{TOTAL}$. To ensure the articles have been properly wrung despite the shortened period, controller 108 can be configured to increase the rotational spin speed of wash basket 120 such that the articles are wrung more aggressively. In yet other embodiments where shorter, more aggressive total cycle times $t_{TOTAL}$ are selected, the first spin cycle portion 208 can be eliminated or omitted from the timed wash cycle 200. In this manner, the first spin time $t_{FIRST\ SPIN}$ of the first spin cycle portion 208 may have a variable cycle time. As the cycle time is variable, controller 108 can vary the cycle time of the first spin cycle portion 208 such that the timed wash cycle 200 is completed by the selected total cycle time $t_{TOTAL}$.

After the first spin cycle portion 208, the articles undergo the rinse cycle portion 210. Lingering additives, detergent, dirt, and/or other debris are removed from the articles during the rinse cycle portion 210. The rinse cycle portion 210 can be accomplished by any suitable method or technique known in the art, such as a deep-fill or deep rinse process, a spray rinse, or a combination of the two methods, for example.

With respect to the deep rinse method, wash tub 121 is filled once again with wash liquid such that the articles received within wash basket 120 are submerged in the wash liquid and re-agitated by agitation element 150 or rotation of wash basket 120. In this way, the detergent, bleach, or other chemical additives can be removed or separated from the articles. The new or fresh wash liquid can contain water only, or alternatively, the wash liquid could contain water and a combination of one or more additives.

In some embodiments, for shorter, more aggressive total cycle times $t_{TOTAL}$, the quantity or volume of wash liquid filled into wash tub 121 can be reduced such that the rinse time $t_{RINSE}$ of the rinse cycle portion 210 can be reduced. For instance, the quantity filled into wash tub 121 during the rinse cycle portion 210 can be less than the quantity filled into wash tub 121 during the fill cycle portion 202. Controller 108 can adjust the cycle time of the rinse cycle portion 210 by adjusting the quantity of wash liquid filled into wash tub 121 or by reducing the amount of time agitation element 150 or wash basket 120 agitates the articles. In this way, rinse cycle portion 210 may have a variable cycle time. Stated alternatively, controller 108 can alter or modify the rinse time $t_{RINSE}$ of the rinse cycle portion 210 such that the wash cycle 200 is completed by the selected total cycle time $t_{TOTAL}$.

With respect to the spray method, generally, wash basket 120 is rotated about as water is sprayed onto the articles. By using a spray method, the articles can be immediately rinsed without need to fill wash tub 121 with a quantity of wash liquid as is done during a deep fill rinse cycle. Thus, a spray rinse technique may provide for a more efficient rinse cycle, as well as reduced water consumption, among other benefits. An exemplary spray method that can be used in accordance with the present disclosure is described in U.S. Pat. No. 7,017,217, which is hereby incorporated by reference in its entirety.

The cycle time of the rinse cycle portion 210 when a spray method is used may be varied. For example, controller 108 can alter or modify the rinse time $t_{RINSE}$ of the rinse cycle portion 210. To do so, one or more steps or processes of the spray method can be altered, modified, or omitted. Additionally or alternatively, controller 108 can control washing machine appliance 100 to spray a greater quantity of wash liquid onto the articles, adjust the rotational spin speed of wash basket 120 to further agitate and wring the articles, change the rotational direction of wash basket 120 at certain intervals, spray the articles with a more pressurized stream of wash liquid, increase the number of spray pulses, etc. In this manner, controller 108 can alter or modify the rinse time $t_{RINSE}$ of the rinse cycle portion 210 such that the timed wash cycle 200 is completed by the selected total cycle time $t_{TOTAL}$, and at the same time, the articles can be properly rinsed despite the shortened cycle time of the rinse cycle portion 210.

After the rinse cycle portion 210, the wash liquid is drained during the second drain cycle portion 212. If a spray method was used during the rinse cycle portion 210, the second drain cycle portion 212 and rinse cycle portion 210 can occur simultaneously, as wash liquid can be drained continuously or throughout the spray method rinse cycle portion 210. In this way, the second drain time $t_{SECOND\ DRAIN}$ for the second drain cycle portion 212 is not additive to the overall total cycle time $t_{TOTAL}$. If a deep rinse method was used during the rinse cycle portion 210, the second drain time $t_{SECOND\ DRAIN}$ for the second drain cycle portion 212 is largely dependent on the quantity of liquid filled into wash tub 121 during the rinse cycle portion 210. Where pump 162 is a single speed pump, the drain rate is fixed and thus known by controller 108. Therefore, the cycle time for the second drain cycle portion 212 is known, and accordingly, the cycle times of other cycle portions can be adjusted accordingly. Moreover, where pump 162 is a variable speed pump, pump 162 can operate to drain the wash liquid from wash tub 121 at a faster rate if a shorter, more aggressive total cycle time $t_{TOTAL}$ is selected by a user.

Finally, the articles received within washing machine 100 undergo the second spin cycle portion 214. Controller 108 can alter or modify the second spin time $t_{SECOND\ SPIN}$ of the second spin cycle portion 214. If the first spin cycle portion 208 is omitted, the second spin cycle portion 214 may be the first time the articles are spun. In a similar fashion to the first spin cycle portion 208, wash basket 120 is spun or rotated about such that wash liquid is wrung from the articles within wash basket 120. For shorter, more aggressive total cycle times $t_{TOTAL}$, the spin speed of wash basket 120 can be increased such that the articles are wrung more aggressively. In this way, articles can be removed from washing machine appliance 100 more "dry" than they would be otherwise. For longer, less aggressive total cycle times, controller 108 can control a motor in mechanical communication with wash basket 120 such that wash basket 120 spins at a slower rate, thereby saving energy.

Figure 6:
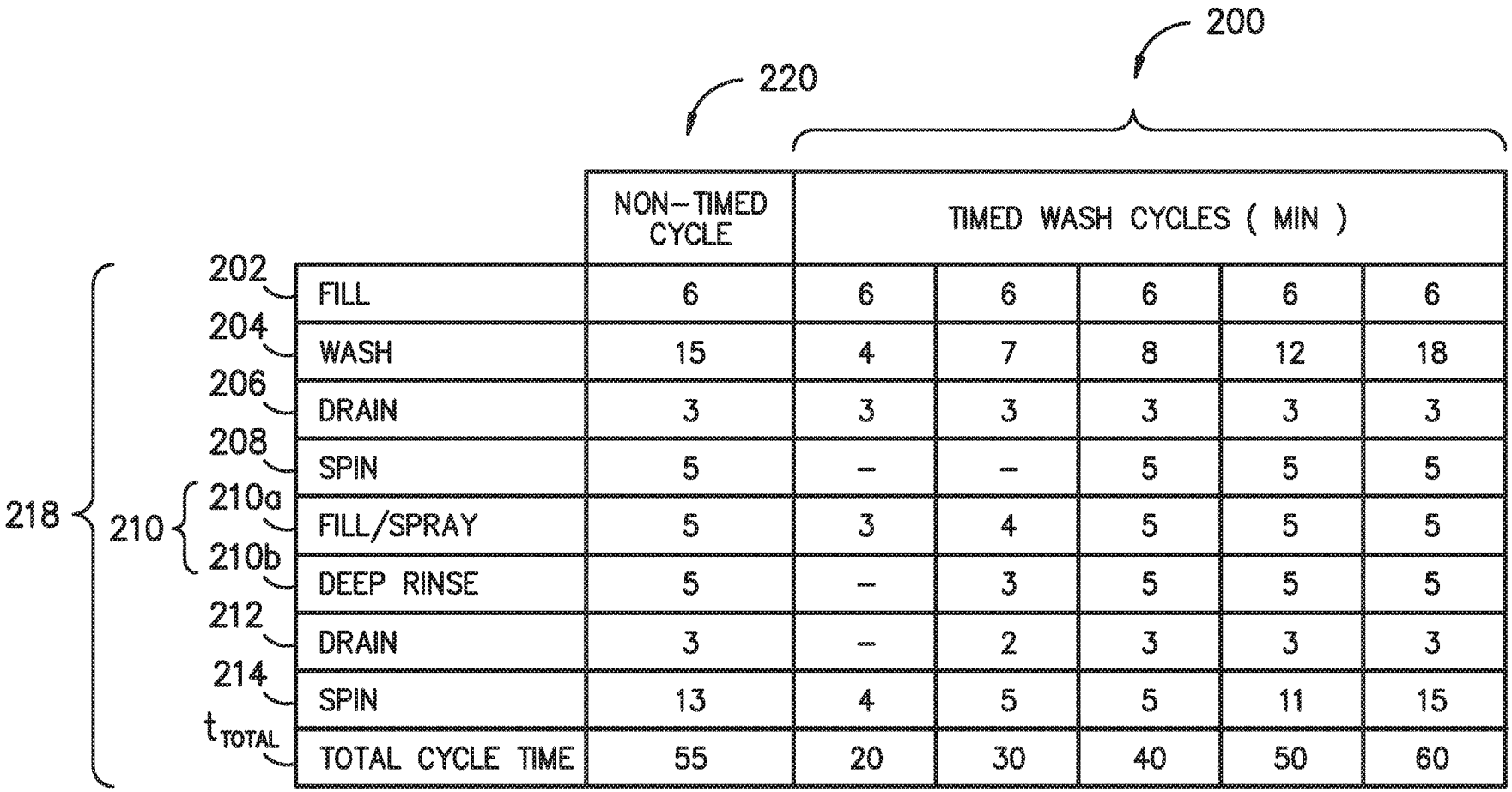
FIG. 6 provides a table of exemplary timed wash cycles in accordance with embodiments of the present disclosure.

FIG. 6 provides an exemplary table of various timed wash cycles 200 in accordance with embodiments of the present disclosure. Specifically, FIG. 6 provides examples of how the cycle times of various cycle portions of timed wash cycle 200 can be adjusted. General reference to the components or portions illustrated in FIGS. 1-5 and described in the accompanying text will also be referenced.

The rows of the table include various cycle portions 218 that may make up one or more of the timed wash cycles 200. Specifically, the rows include the fill cycle portion 202, the wash cycle portion 204, the first drain cycle portion 206, the first spin cycle portion 208, the rinse cycle portion 210, which can include a fill/spray portion 210*a* and/or a deep rinse portion 210*b*, the second drain cycle portion 212, and the second spin cycle portion 214, as well as the total time for each wash cycle. In addition, the bottom row of the table indicates the total cycle time $t_{TOTAL}$ of each exemplary timed wash cycle 200, as well the non-timed cycle 220. Particularly, the total cycle times $t_{TOTAL}$ represent the summation of the cycle times of the various cycle portions 218 of their respective timed washed cycles 200 and non-timed cycle 220.

For the rinse cycle portion 210, the fill/spray portion 210*a* can represent either the filling of wash tub 121 during a deep fill method rinse or the cycle time for the spray rinse method in which wash basket 120 is rotated about while the articles are sprayed with wash liquid. The deep rinse portion 210*b* of the rinse cycle portion 210 is applicable only if the deep fill rinse method was used and is representative of the cycle time for agitation element 150, wash basket 120, or a combination thereof to agitate the articles within wash basket 120 while the articles are submerged in wash liquid.

The first column of the table includes a non-timed cycle 220, or a wash cycle in which a total cycle time $t_{TOTAL}$ was not set. Stated alternatively, non-timed cycle 220 was completed without a timed wash cycle 200. Washing machine appliance 100 was in operation during the non-timed cycle 220 for fifty-five (55) minutes for the particular load and selected cycle parameters 190. As shown, the fill cycle portion 202 of non-timed cycle 220 took six (6) minutes; the wash cycle portion 204 took fifteen (15) minutes; the first drain cycle portion 206 took three (3) minutes; the first spin cycle portion 208 took five (5) minutes; the rinse cycle portion 210 took a total of ten (10) minutes, with five (5) minutes allocated to filling wash tub 121 with wash liquid during the fill portion 210*a* and five (5) minutes allocated to agitation of the articles during the deep rinse portion 210*b* of the rinse cycle portion 210; the second drain cycle portion 212 took three (3) minutes; and the second spin cycle portion 214 took thirteen (13) minutes.

The other columns of the table show various timed wash cycles 200. As shown, the timed wash cycles included: a twenty (20) minute timed wash cycle, a thirty (30) minute timed wash cycle, a forty (40) minute timed wash cycle, a fifty (50) minute timed wash cycle, and a sixty (60) minute timed wash cycle. Each timed wash cycle will be discussed in turn. The load size used for the non-timed cycle 220 was used for each timed wash cycle 200 such that the fill time $t_{FILL}$ of the fill cycle portion 202 was held constant for each timed wash cycle 200 at six (6) minutes. The same washing machine appliance 100 was used for all examples, and washing machine appliance included pump 162, which is a single speed pump; thus, the drain rates were also held constant for each timed wash cycle 200. The table illustrates how the cycle times of various cycle portions 218 of non-timed cycle 220 can be adjusted or omitted such that timed wash cycle 200 is completed by the selected total cycle time $t_{TOTAL}$.

For the twenty (20) minute timed wash cycle 200, the timed wash cycle 200 was reduced by thirty-five (35) minutes from the fifty-five (55) minute non-timed cycle 220. The fill time of the fill cycle portion 202 of the twenty (20) minute timed wash cycle 200 remained the same as that of the non-timed cycle 220 at six (6) minutes, as the load size was the same as that of the non-timed cycle 220 as noted above. Thus, about the same quantity of wash liquid was filled into wash tub 121 of washing machine appliance 100.

To achieve the reduced total cycle time $t_{TOTAL}$ of twenty (20) minutes, the wash cycle portion 204 was reduced from fifteen (15) minutes to four (4) minutes. To ensure the articles were washed sufficiently during the wash cycle portion 204 even with the reduced cycle time (or at least better washed than they would have been otherwise), the agitation level, or in this example the driving torque, of agitation element 150 was increased such that agitation element 150 applied a greater force on the articles and wash liquid. In this way, the articles were more aggressively agitated.

The first drain cycle portion 206 of the twenty (20) minute timed wash cycle 200 also remained the same as that of the non-timed cycle 220 at three minutes (3), as the amount of wash liquid that filled into wash tub 121 is dependent on the load size, and as noted above, the load size was held constant across all timed wash cycle examples. For the twenty (20) minute-timed wash cycle, the first spin cycle portion was omitted to save time; thus the twenty (20) minute timed wash cycle 200 skips from the first drain cycle portion 206 to the rinse cycle portion 210. As shown, the rinse cycle portion 210 was reduced from five (5) minutes to three (3) minutes. Moreover, a spray rinse method or technique was used to save time. When a spray method is used for the rinse cycle portion 210, the wash liquid sprayed onto the articles within wash basket 120 can be continuously drained from wash tub 121, as noted above. In addition, the deep rinse portion 210*b* of the rinse cycle portion 210 was omitted as it is only applicable to the deep fill rinse method. To complete the twenty (20) minute timed wash cycle 200, the second spin cycle portion 214 was reduced from thirteen (13) minutes to four (4) minutes. To wring out or dry the articles more aggressively, the spin speed of wash basket 120 was increased.

For the thirty (30) minute timed wash cycle, the wash cycle was reduced by twenty-five (25) minutes from the fifty-five (55) minute non-timed cycle 220. The sense/fill cycle portion of the thirty (30) minute-timed wash cycle remained the same as that of the non-timed cycle 220 at six (6) minutes, as the load size was the same as that of the non-timed cycle 220 as noted above. Thus, about the same quantity of wash liquid filled wash tub 121 of washing machine appliance 100. To achieve the reduced total cycle time of thirty (30) minutes, the wash cycle portion was reduced from fifteen (15) minutes to seven (7) minutes. In a similar fashion to the twenty (20) minute timed wash cycle 200, the agitation level of agitation element 150 was increased such that agitation element 150 more aggressively agitated the articles.

The first drain cycle portion 206 of the thirty (30) minute timed wash cycle 200 also remained the same as that of the non-timed cycle 220 at three minutes (3), as the amount of wash liquid that filled into the tub is dependent on the load size, and as noted above, the load size was held constant across all timed cycle examples. For the thirty (30) minute-timed wash cycle 200, the first spin cycle portion was omitted to save time; thus, the thirty (30) minute timed wash cycle 200 skipped right to the rinse cycle portion 210.

As shown, the rinse cycle portion 210 was reduced from five (10) minutes to seven (7) minutes (considering both portions 210*a* and 210*b* of the rinse cycle portion 210). Specifically, the deep fill rinse method was used for the rinse cycle portion 210 for the thirty (30) minute timed wash cycle 200. For the fill portion 210*a*, the time was reduced by one (1) minute from the non-timed cycle 220 from five (5) to four (4) minutes; accordingly, the amount of wash liquid that filled into wash tub 121 was reduced. Not only does filling wash tub 121 with a lesser quantity of wash liquid save time during the filling process, but it also saves time when the wash liquid is drained. For the deep rinse portion 210*b*, the time for the thirty (30) minute timed wash cycle 200 was reduced by two (2) minutes from the non-timed cycle 220 from five (5) to three (3) minutes, saving time.

The second drain cycle portion 212 was reduced from three (3) minutes to two (2) minutes, as less drain time was necessary because the quantity of wash liquid that filled into wash tub 121 during the rinse cycle portion 210 was reduced. Moreover, to complete the thirty (30) minute timed wash cycle 200, the second spin cycle portion 214 was reduced from thirteen (13) minutes to five (5) minutes. To wring out or dry the articles more aggressively, the spin speed of wash basket 120 was increased.

For the forty (40) minute timed wash cycle 200, the total cycle time $t_{TOTAL}$ was reduced by fifteen (15) minutes from the fifty-five (55) minute non-timed cycle 220. The fill cycle portion 202 remains the same at six (6) minutes, as the same load was used for each timed cycle. During the fill cycle portion 202, controller 108 opened up one or more valves connected to a hot water line to increase the wash liquid temperature of the wash liquid filling into wash tub 121 of washing machine appliance 100 such that the articles within the washing machine appliance were subjected to more aggressive thermal action.

To achieve the reduced total cycle time of forty (40) minutes, the wash cycle portion 204 was reduced from fifteen (15) minutes to eight (8) minutes. In a similar fashion to the twenty (20) and thirty (30) minute timed wash cycles 200, the agitation level of agitation element 150 was increased such that agitation element 150 more aggressively agitated the articles. The increased mechanical and thermal action provided by the increased agitation level of agitation element 150 and increased wash liquid temperature ensures that the articles within wash basket 120 are better washed than they would be otherwise considering the shorten, more aggressive cycle time for the wash cycle portion 204.

The first drain cycle portion 206 of the forty (40) minute timed wash cycle 200 also remained the same as that of the non-timed cycle 220 at three minutes (3). Next, the articles within the washing machine appliance underwent a first spin cycle portion for five (5) minutes, which is the same as the non-timed cycle 220. Thereafter, the washing machine appliance performed a fill/rinse cycle portion of five (5) minutes, a rinse cycle portion of three (3) minutes, and a second drain portion of three (3) minutes. Each of the cycle times of these cycle portions lasted the same amount of time as the non-timed cycle 220. To complete the forty (40) minute timed wash cycle 200, the second spin cycle portion 214 was reduced from thirteen (13) minutes to five (5) minutes. To wring out or dry the articles more aggressively, the spin speed of wash basket 120 was increased during the second spin portion 214 to more aggressively dry the articles.

For the fifty (50) minute timed wash cycle, the wash cycle was reduced by a total of five (5) minutes from the non-timed cycle 220. To achieve the reduced time, the wash cycle portion was reduced from fifteen (15) minutes to twelve (12) minutes and the second spin cycle was reduced from thirteen (13) minutes to eleven (11) minutes. All other cycle portions remained the same as those of the non-timed cycle 220.

For the sixty (60) minute timed wash cycle, the wash cycle was increased by a total of five (5) minutes from non-timed cycle 220. To achieve the increased total cycle time, the wash cycle portion 204 was increased from fifteen (15) minutes to eighteen (18) minutes and the second spin cycle portion 214 was increased from thirteen (13) minutes to fifteen (15) minutes. All other cycle portions remained the same as those of the non-timed cycle 220. During the wash cycle portion 204, the agitation level of agitation element 150 was decreased to save energy. Specifically, the rotational speed of agitation element was decreased. Moreover, during the second spin cycle portion 214, the rotational spin speed of wash basket 120 was reduced to save energy. Controller 108, recognizing that user has selected a total cycle time $t_{TOTAL}$ that is greater than the time for the non-timed cycle 220 for that particular load size and selected parameters, can adjust the components of washing machine appliance 100 to operate more efficiently. Alternatively, a user can manipulate washing machine appliance 100 such that it does not adjust various components (e.g., the agitation level or rotational spin speed of wash basket 120) during operation of a timed wash cycle.

Figure 7:
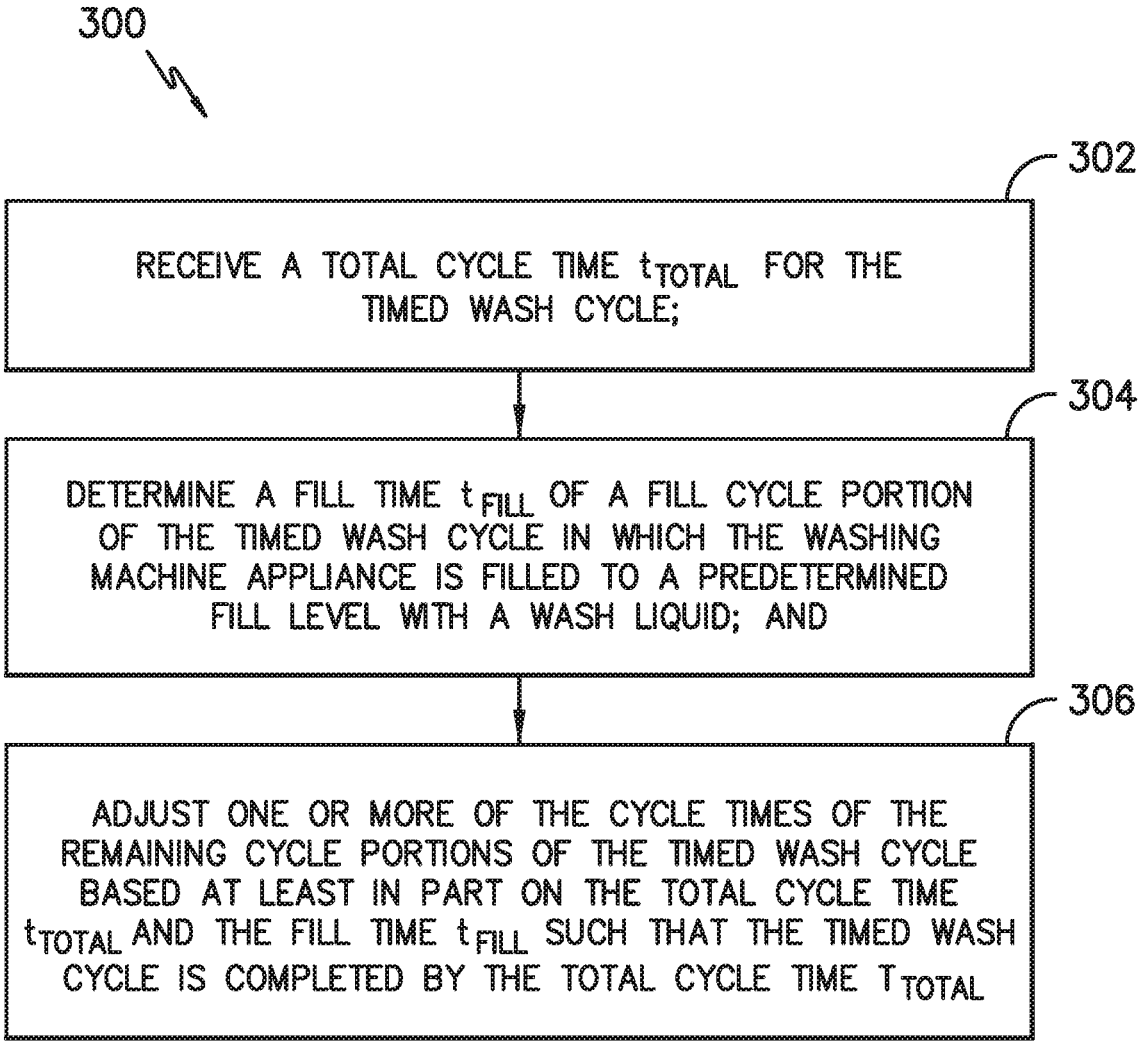
FIG. 7 provides a flow diagram of an exemplary method in accordance with embodiments of the present disclosure.

FIG. 7 provides an exemplary flow diagram of an exemplary method (300) for operating washing machine appliance 100 in timed wash cycle 200 according to exemplary embodiments of the present subject matter. FIG. 7 depicts method (300) in a particular order for purposes of illustration and discussion. However, it will be appreciated that exemplary method (300) can be modified, adapted, expanded, rearranged and/or parts of method (300) can be omitted in various ways without deviating from the scope of the present subject matter. General reference to the components or portions illustrated in FIGS. 1-6 and described in the accompanying text will also be referenced.

At (302), exemplary method (300) includes receiving total cycle time $t_{TOTAL}$ for timed wash cycle 200. For example, a user can select a total cycle time of twenty minutes (20), thirty minutes (30), forty minutes (40), fifty minutes (50), sixty minutes (60), or any other suitable total cycle time. The total cycle time $t_{TOTAL}$ is indicative of the total time of a given wash cycle. As noted above, the timed wash cycle 200 includes one or more cycle portions 218 each having a corresponding cycle time.

At (304), exemplary method (300) includes determining a fill time $t_{FILL}$ of fill cycle portion 202 of the timed wash cycle 200 in which washing machine appliance 100 is filled to a predetermined fill level with a wash liquid. The predetermined fill level can be based on the sensed load size of the articles within washing machine appliance 100 or by user selection of a particular load size or type of load, e.g., "large load." The fill time $t_{FILL}$ can include both the time for sensing the load size and filling of wash tub 121 with wash liquid.

At (306), exemplary method (300) includes adjusting one or more of the cycle times of the remaining cycle portions of the timed wash cycle 200 based at least in part on the total cycle time $t_{TOTAL}$ and the fill time $t_{FILL}$ such that the timed wash cycle 200 is completed by the total cycle time $t_{TOTAL}$. For this embodiment, once the total cycle time $t_{TOTAL}$ is received and the fill time $t_{FILL}$ of the fill cycle portion 202 is determined, controller 108 of washing machine appliance 100 can adjust one or more cycle times of one or more of the remaining cycle portions 218 that make up the timed wash cycle 200.

In yet other implementations, the method (300) can further include adjusting an agitation level of agitation element 150 during the timed wash cycle 200 based at least in part on the total cycle time $t_{TOTAL}$. For example, the agitation level of agitation element 150 can be adjusted during the wash cycle portion 204 of timed wash cycle 200, for example. The agitation level can be a frequency, a torque, a rotational speed, or a combination thereof of agitation element 150, for example. In one respect, where a shorter, more aggressive timed wash cycle 200 is selected by a user (e.g., twenty minutes (20)), to ensure the articles are properly washed within the relatively short total cycle time $t_{TOTAL}$, agitation element 150 can be configured to operate with more frequency, torque, or rotational speed such that the articles within washing machine appliance 100 are agitated more aggressively. In another respect, where a longer, less aggressive total cycle time $t_{TOTAL}$ is selected by a user, agitation element 150 can be configured to operate with less frequency, torque, or rotational speed such that the articles within washing machine appliance 100 are agitated less aggressively, thereby saving energy.

In some exemplary implementations, the method (300) can further include adjusting a wash liquid temperature of a wash liquid filling into washing machine appliance 100 based at least in part on the total cycle time $t_{TOTAL}$. In one respect, where a shorter, more aggressive total cycle time $t_{TOTAL}$ is selected by a user, washing machine appliance 100, or more specifically controller 108, can be configured to receive warmer liquid from a liquid source in fluid communication with washing machine appliance 100. Additionally or alternatively, washing machine appliance 100 can include a heating element configured to heat the incoming wash liquid to the desired temperature. By increasing the wash liquid temperature, the increased thermal action causes the wash liquid to more aggressively remove stains, dirt, and other debris from the articles. In another respect, where a longer, less aggressive total cycle time $t_{TOTAL}$ is selected by a user, the wash liquid temperature can be reduced or lowered, which may, for example, save energy.

In other exemplary implementations, the method (300) can further include adjusting a spin speed of wash basket 120 based at least in part on the total cycle time $t_{TOTAL}$. In one respect, where a shorter, more aggressive total cycle time $t_{TOTAL}$ is selected by a user, washing machine appliance 100, or more specifically controller 108, can be configured to increase the spin speed of wash basket 120 during certain cycle portions 218 of the timed wash cycle 200, such as e.g., a spin cycle portion 208, 214. In this way, the articles removed from washing machine appliance 100 after the wash cycle 200 are drier than they would be otherwise. In another respect, where a longer, less aggressive total cycle time $t_{TOTAL}$ is selected by a user, the rotational speed of wash basket 120 can be reduced such that energy can be saved.

In yet other exemplary implementations, for the rinse cycle portion 210, instead of a deep fill rinse method, a spray rinse method can be used to reduce time overall cycle time and save energy.

Figure 8:
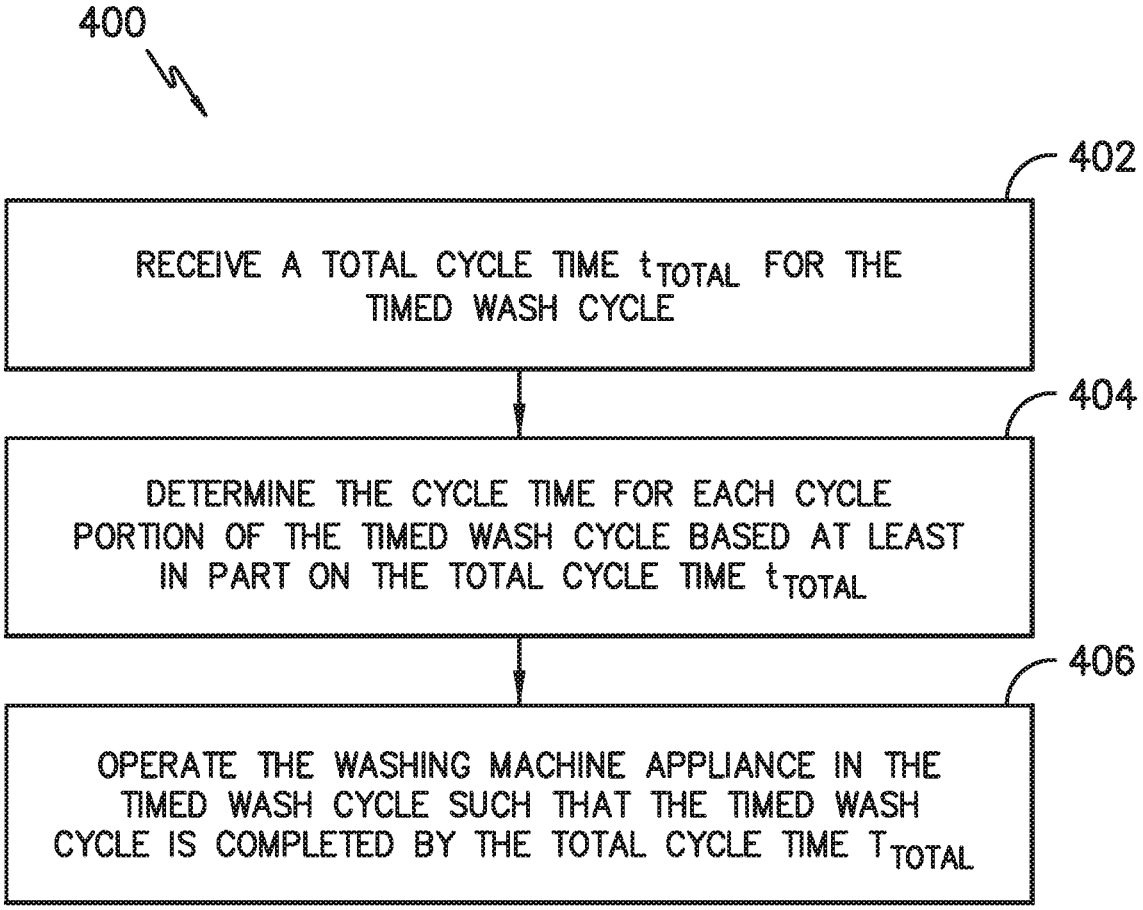
FIG. 8 provides a flow diagram of another exemplary method in accordance with embodiments of the present disclosure.

FIG. 8 provides an exemplary flow diagram of an exemplary method (400) for operating washing machine appliance 100 in timed wash cycle 200 according to exemplary embodiments of the present subject matter. The timed wash cycle 200 includes one or more cycle portions each having a corresponding cycle time. FIG. 8 depicts method (400) in a particular order for purposes of illustration and discussion. However, it will be appreciated that exemplary method (400) can be modified, adapted, expanded, rearranged and/or parts of method (400) can be omitted in various ways without deviating from the scope of the present subject matter. General reference to the components or portions illustrated in FIGS. 1-6 and described in the accompanying text will also be referenced.

At (402), exemplary method (400) includes receiving a total cycle time $t_{TOTAL}$ for the timed wash cycle 200.

At (404), exemplary method (400) includes determining the cycle time for each cycle portion 218 of the timed wash cycle 200 based at least in part on the total cycle time $t_{TOTAL}$. In some implementations, for example, depending on the selected total cycle time $t_{TOTAL}$, each cycle portion 218 may have an associated fixed cycle time for that particular total cycle time $t_{TOTAL}$. For instance, if the total cycle time $t_{TOTAL}$ is selected as thirty minutes (30), the cycle times of the cycle portions 218 may be fixed as follows: the fill cycle portion 202 may have a fixed fill time $t_{FILL}$ of five minutes (5); the wash cycle portion 204 may have a fixed wash time $t_{WASH}$ of seven minutes (7); the first drain cycle portion 206 may have a fixed first drain time $t_{FIRST\ DRAIN}$ of three minutes (3); the first spin cycle portion 208 may have a fixed first spin time $t_{FIRST\ SPIN}$ of one minute (1); the rinse cycle portion 210 may have a fixed rinse time $t_{RINSE}$ of seven minutes (7); the second drain cycle portion 212 may have a fixed second drain time $t_{SECOND\ DRAIN}$ of two minutes (2); and finally, the second spin cycle portion 214 may have a fixed second spin time $t_{SECOND\ SPIN}$ of five minutes (5), totaling thirty minutes (30). In such embodiments, controller 108 can use one or more lookup tables or the like to determine the cycle times of the various cycle portion 218 based on the selected total cycle time $t_{TOTAL}$.

At (406), exemplary method (400) includes operating washing machine appliance 100 in the timed wash cycle 200 such that the timed wash cycle 200 is completed by the total cycle time $t_{TOTAL}$.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance for performing a timed wash cycle comprised of one or more cycle portions each having a corresponding cycle time, the washing machine appliance comprising:

a cabinet defining an opening;

a wash tub positioned within the cabinet;

a wash basket rotatably mounted within the tub, the wash basket defining a wash chamber for receiving articles for washing;

a control panel attached to or integral with the cabinet and comprising one or more input selectors for selecting a total cycle time $t_{TOTAL}$ for the timed wash cycle; and a controller operatively coupled with the control panel, the controller configured to:

receive a total cycle time $t_{TOTAL}$ for the timed wash cycle;

determine the cycle time for each cycle portion of the timed wash cycle based solely on the total cycle time $t_{TOTAL}$; and operate the washing machine appliance in the timed wash cycle such that the timed wash cycle is completed by the total cycle time $t_{TOTAL}$.

2. A washing machine appliance for performing a timed wash cycle comprised of one or more cycle portions each having a corresponding cycle time, the one or more cycle portions including a wash cycle portion, the washing machine appliance comprising:

a cabinet defining an opening;

a wash tub positioned within the cabinet;

a wash basket rotatably mounted within the tub, the wash basket defining a wash chamber for receiving articles for washing;

a control panel attached to or integral with the cabinet and comprising one or more input selectors for selecting a total cycle time $t_{TOTAL}$ for the timed wash cycle;

a controller operatively coupled with the control panel and the wash basket, the controller configured to:

receive the total cycle time $t_{TOTAL}$ for the timed wash cycle;

determine an initial fill time $t_{FILL}$ of an initial fill cycle portion for a wash liquid to fill into the wash tub to a predetermined fill level; and adjust one or more of the cycle times of the remaining cycle portions of the timed wash cycle based at least in part on the total cycle time $t_{TOTAL}$ and the initial fill time $t_{FILL}$ such that the timed wash cycle is completed by the total cycle time $t_{TOTAL}$; and adjust a spin speed of the wash basket based at least in part on the total cycle time $t_{TOTAL}$ such that articles within the wash chamber are spun more aggressively.

3. The washing machine appliance of claim 2, wherein the washing machine appliance further comprises:

an additive dispenser, and wherein the controller is operatively coupled with the additive dispenser, and wherein the controller is further configured to:

adjust a quantity of detergent or fluid additives dispensed into the wash tub via the additive dispenser based at least in part on the initial fill time $t_{FILL}$ and the total cycle time $t_{TOTAL}$.

4. The washing machine appliance of claim 2, wherein the one or more cycle portions include a drain cycle portion, and wherein the washing machine appliance further comprises:

a pump assembly for draining the wash tub, the pump assembly having a variable speed pump and a pump motor for driving the pump, and wherein the controller is operatively coupled with the pump motor, and wherein the controller is further configured to:

adjust the pump motor to cause the pump to drain the wash tub at a different drain rate based at least in part on the initial fill time $t_{FILL}$ and the total cycle time $t_{TOTAL}$.

5. A washing machine appliance for performing a timed wash cycle comprised of one or more cycle portions each having a corresponding cycle time, the one or more cycle portions including a wash cycle portion, the washing machine appliance comprising:

a cabinet defining an opening;

a wash tub positioned within the cabinet;

a wash basket rotatably mounted within the tub, the wash basket defining a wash chamber for receiving articles for washing;

a control panel attached to or integral with the cabinet and comprising one or more input selectors for selecting a total cycle time $t_{TOTAL}$ for the timed wash cycle;

an agitation element configured to agitate articles received within the wash chamber; and a controller operatively coupled with the control panel and the agitation element, the controller configured to:

receive the total cycle time $t_{TOTAL}$ for the timed wash cycle;

determine an initial fill time $t_{FILL}$ of an initial fill cycle portion for a wash liquid to fill into the wash tub to a predetermined fill level; and adjust one or more of the cycle times of the remaining cycle portions of the timed wash cycle based at least in part on the total cycle time $t_{TOTAL}$ and the initial fill time $t_{FILL}$ such that the timed wash cycle is completed by the total cycle time $t_{TOTAL}$; and adjust an agitation level of the agitation element during the wash cycle portion based at least in part on the total cycle time $t_{TOTAL}$ such that articles received within the wash chamber are agitated more aggressively.

6. The washing machine appliance of claim 5, wherein the initial fill time $t_{FILL}$ is based at least in part on a load size of articles received within the wash chamber.

7. The washing machine appliance of claim 5, wherein the timed wash cycle comprises a fill cycle portion and wherein the controller is further configured to:

adjust a wash liquid temperature of a wash liquid filling into the wash chamber during the fill cycle portion based at least in part on the total cycle time $t_{TOTAL}$ such that the articles within the wash chamber are subjected to more aggressive thermal action.

8. The washing machine appliance of claim 5, wherein the wash basket is operatively coupled with the controller, and wherein the controller is further configured to:

adjust a spin speed of the wash basket based at least in part on the total cycle time $t_{TOTAL}$ such that the articles within the wash chamber are spun more aggressively.

9. The washing machine appliance of claim 5, wherein the controller is further configured to:

adjust at least one of a frequency, a rotational speed, and a torque of the agitation element by the adjustment of the spin speed.

10. The washing machine appliance of claim 5, wherein the controller is further configured to:

adjust, during the adjustment of the one or more of the cycle times, at least one of the cycle times such that the corresponding cycle portion is omitted from the timed wash cycle.

11. The washing machine appliance of claim 5, wherein the controller is further configured to:

adjust, during the adjustment of the one or more of the cycle times, two or more of the cycle times such that two or more cycle portions are omitted from the timed wash cycle.

12. The washing machine appliance of claim 5, wherein the controller is further configured to:

receive one or more cycle parameters, wherein the one or more cycle parameters include at least one of: a wash liquid temperature, a soil level, and a spin speed; and adjust one or more of the cycle parameters such that the one or more articles received within the washing machine appliance are subjected to increased mechanical action or increased thermal action during one or more cycle portions of the timed wash cycle.

13. The washing machine appliance of claim 5, wherein the one or more cycle portions include:

the wash cycle portion, a drain cycle portion, a rinse cycle portion, and a spin cycle portion, wherein the controller is further configured to:

shorten in time, during the adjustment of the one or more of the cycle times, at least one of the cycle times corresponding to the wash cycle portion, the rinse cycle portion, and the spin cycle portion such that the timed wash cycle is completed by the total cycle time $t_{TOTAL}$.

14. The washing machine appliance of claim 5, wherein the timed wash cycle comprises a fill cycle portion and a rinse cycle portion, and wherein the controller is further configured to:

fill a first quantity of wash liquid into the washing machine appliance during the fill cycle portion; and fill a second quantity of wash liquid into the washing machine appliance during the rinse cycle portion, the first quantity being greater than the second quantity.

15. The washing machine appliance of claim 5, wherein the timed wash cycle comprises a rinse cycle portion, and wherein the controller is further configured to:

initiate a spray method during the rinse cycle portion.

16. The washing machine appliance of claim 5, wherein the controller is further configured to:

sense a load size of the articles received within the wash basket during a time period, wherein the fill time $t_{FILL}$ includes the time period in which the load size is sensed.

17. The washing machine appliance of claim 5, wherein the washing machine appliance further comprises:

an additive dispenser, and wherein the controller is operatively coupled with the additive dispenser, and wherein the controller is further configured to:

adjust a quantity of detergent or fluid additives dispensed into the wash tub via the additive dispenser based at least in part on the initial fill time $t_{FILL}$ and the total cycle time $t_{TOTAL}$.

18. The washing machine appliance of claim 5, wherein the timed wash cycle comprises a drain cycle portion, and wherein the washing machine appliance further comprises:

a pump assembly for draining the wash tub, the pump assembly having a variable speed pump and a pump motor for driving the pump, and wherein the controller is operatively coupled with the pump motor, and wherein the controller is further configured to:

adjust the pump motor to cause the pump to drain the wash tub at a different drain rate based at least in part on the initial fill time $t_{FILL}$ and the total cycle time $t_{TOTAL}$.

19. The washing machine appliance of claim 5, wherein the initial fill time $t_{FILL}$ corresponds to a time period extending from when a user commences the timed wash cycle to when the predetermined fill level is achieved.

20. The washing machine appliance of claim 5, wherein in determining the initial fill time $t_{FILL}$ of the initial fill cycle portion, the controller is configured to:

receive an input indicative of a load size of the articles received within the wash basket;

receive an input indicative of a fabric type of the articles received within the wash basket;

estimate the initial fill time $t_{FILL}$ based at least in part on the input indicative of the load size of the articles received within the wash basket and the input indicative of the fabric type of the articles received within the wash basket, and wherein the controller adjusts the one or more of the cycle times of the remaining cycle portions of the timed wash cycle based at least in part on the total cycle time $t_{TOTAL}$ and the estimated initial fill time $t_{FILL}$ such that the timed wash cycle is completed by the total cycle time $t_{TOTAL}$.

* * * * *